US011454927B2

(12) United States Patent
Nakazawa et al.

(10) Patent No.: US 11,454,927 B2
(45) Date of Patent: Sep. 27, 2022

(54) IMAGE FORMING APPARATUS WITH PARTICLE COLLECTOR

(71) Applicant: HEWLETT-PACKARD DEVELOPMENT COMPANY, L.P., Fort Collins, CO (US)

(72) Inventors: Takashi Nakazawa, Yokohama (JP); Manabu Ono, Yokohama (JP)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 190 days.

(21) Appl. No.: 16/961,105

(22) PCT Filed: Oct. 11, 2018

(86) PCT No.: PCT/KR2018/011917

§ 371 (c)(1),
(2) Date: Jul. 9, 2020

(87) PCT Pub. No.: WO2019/139224

PCT Pub. Date: Jul. 18, 2019

(65) Prior Publication Data

US 2021/0063962 A1 Mar. 4, 2021

(30) Foreign Application Priority Data

Jan. 10, 2018 (JP) ..... JP2018-001771

(51) Int. Cl.

| | |
|---|---|
| ***G03G 21/20*** | (2006.01) |
| ***B03C 3/08*** | (2006.01) |
| ***B03C 3/12*** | (2006.01) |
| ***B03C 3/155*** | (2006.01) |
| ***B03C 3/28*** | (2006.01) |

(Continued)

(52) U.S. Cl.

CPC ..... *G03G 21/206* (2013.01); *B03C 3/017* (2013.01); *B03C 3/08* (2013.01); *B03C 3/12* (2013.01); *B03C 3/155* (2013.01); *B03C 3/28* (2013.01); *B03C 3/368* (2013.01); *B03C 3/41* (2013.01); *B03C 2201/06* (2013.01); *B03C 2201/10* (2013.01)

(58) Field of Classification Search

CPC ..... G03G 15/2017; G03G 21/206; G03G 2221/1645

USPC ..... 399/92, 93, 98

See application file for complete search history.

(56) References Cited

U.S. PATENT DOCUMENTS 9,158,275 B2 * 10/2015 Inami et al. ..... G03G 21/206
9,176,472 B2 * 11/2015 Nakayama et al. . G03G 21/206

(Continued)

FOREIGN PATENT DOCUMENTS

JP 2006251737 9/2006
JP 2008076777 4/2008

(Continued)

*Primary Examiner* — William J Royer
(74) *Attorney, Agent, or Firm* — Staas & Halsey LLP

(57) ABSTRACT

An image forming apparatus includes a flow passage associated with a direction of flow and a particle collecting device including a filter to collect particles in a fluid passing through the flow passage in the direction of flow. The flow passage includes a curved portion, and a distribution in particle collecting performance of the filter in a direction perpendicular to the direction of flow results from the curved portion of the flow passage.

15 Claims, 6 Drawing Sheets

(51) Int. Cl.

| | |
|---|---|
| ***B03C 3/41*** | (2006.01) |
| ***B03C 3/017*** | (2006.01) |
| ***B03C 3/36*** | (2006.01) |

(56) References Cited

U.S. PATENT DOCUMENTS

| | | | | |
|---|---|---|---|---|
| 10,054,883 | B2 * | 8/2018 | Nanjo et al. ..... | G03G 15/2017 |
| 10,241,463 | B2 * | 3/2019 | Yabuki et al. ..... | G03G 21/206 |
| 2020/0363770 | A1 * | 11/2020 | Ono et al. ..... | G03G 21/206 |

FOREIGN PATENT DOCUMENTS

| | | |
|---|---|---|
| JP | 2010029740 | 2/2010 |
| JP | 2014066978 | 4/2014 |
| JP | 2017120404 | 7/2017 |

* cited by examiner

【Figure 1】
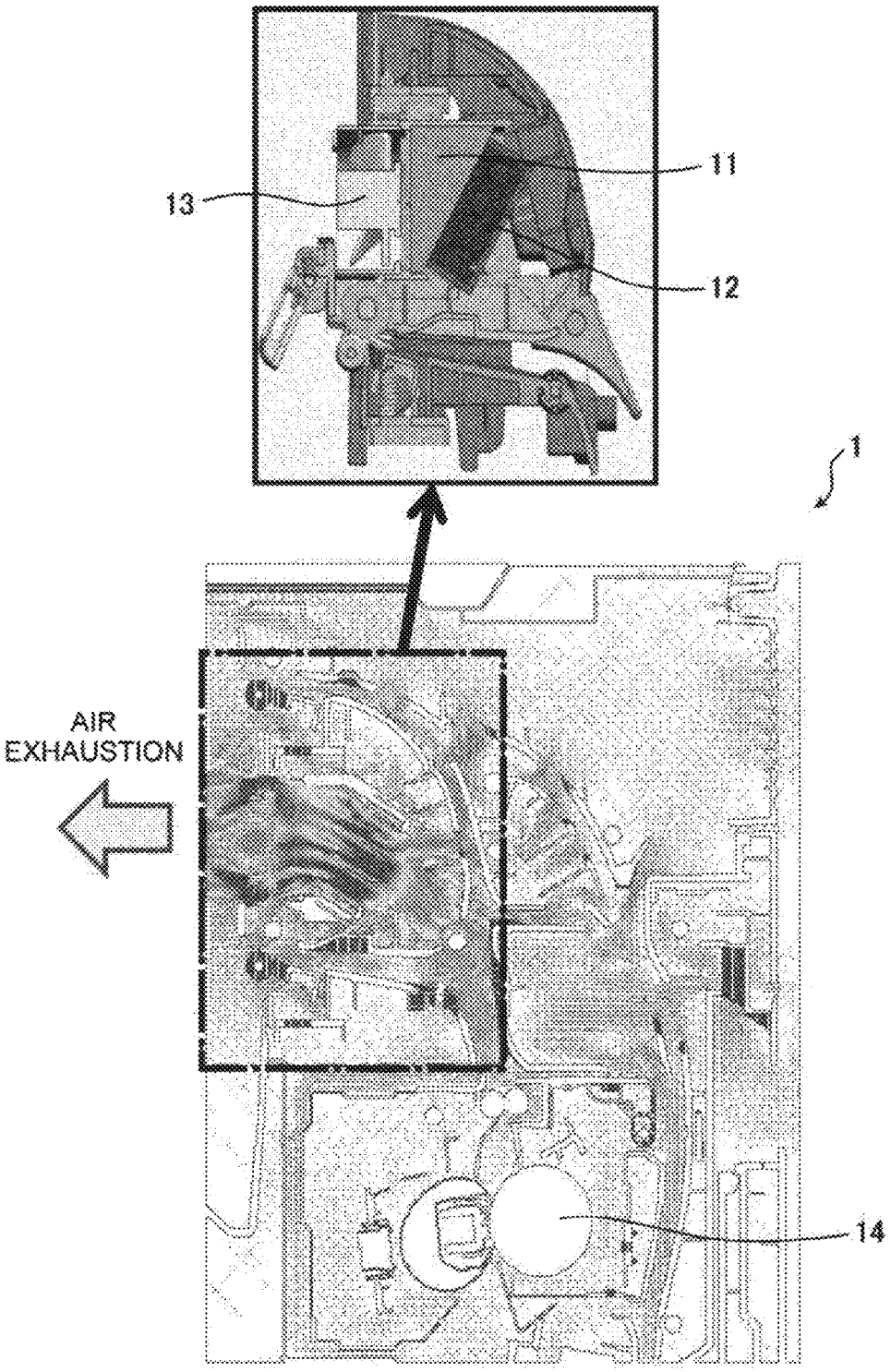

【Figure 2】
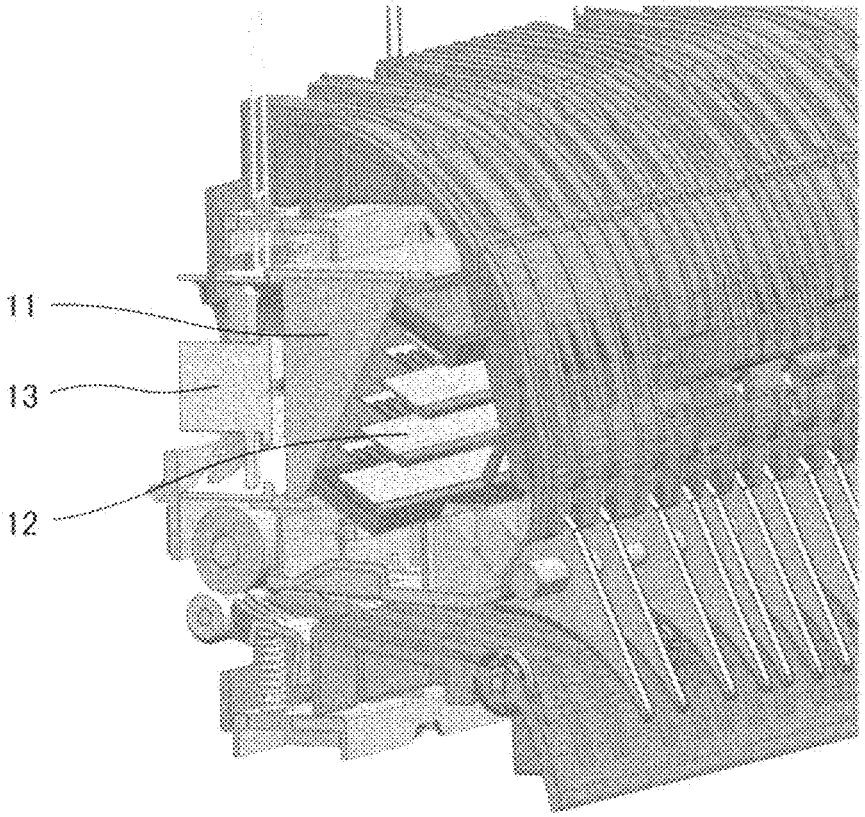
【Figure 3】
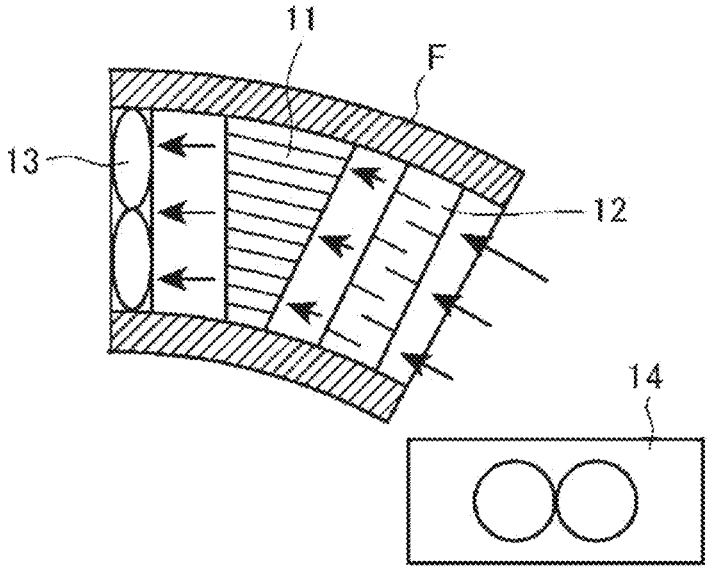

【Figure 4】
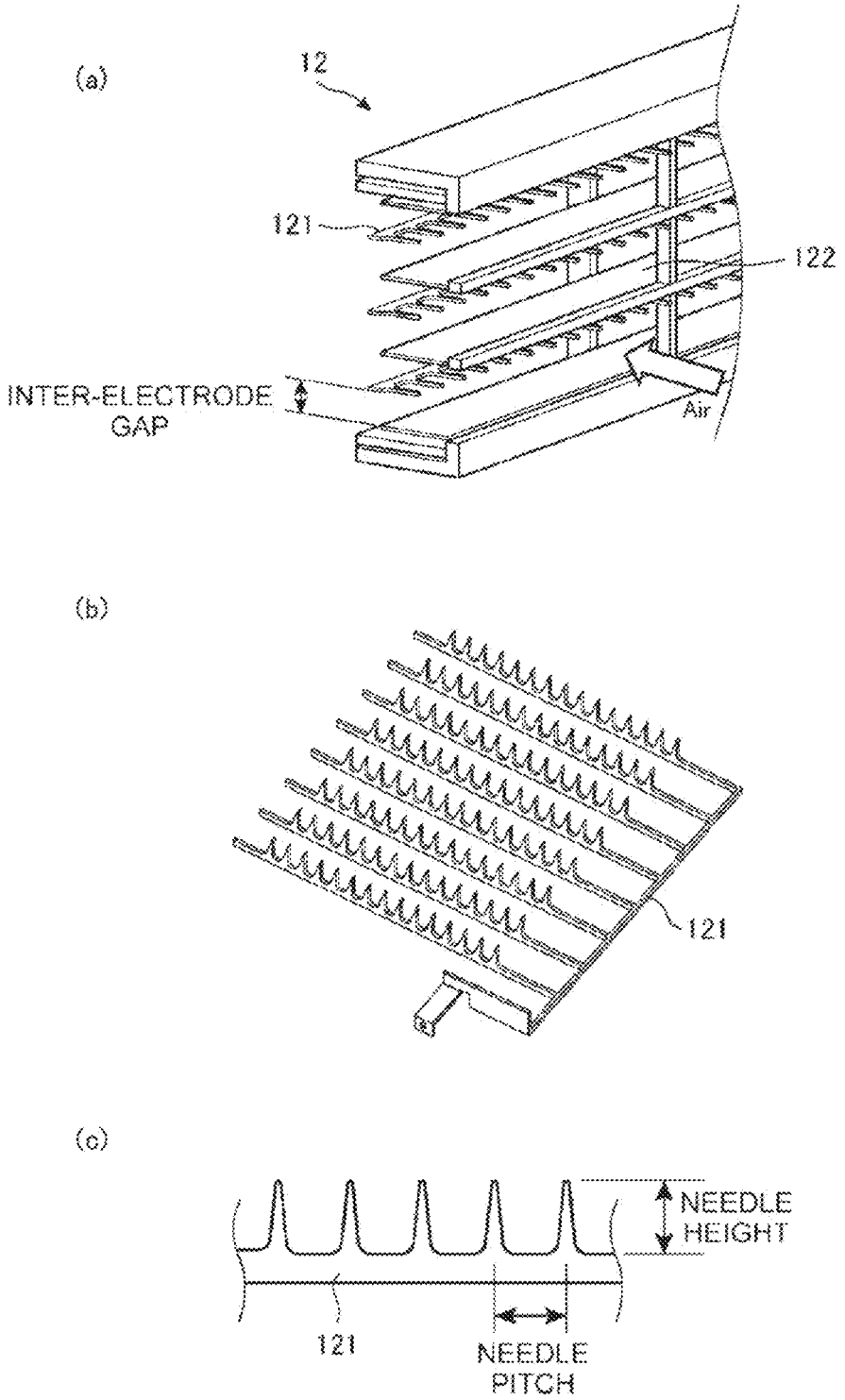

【Figure 5】
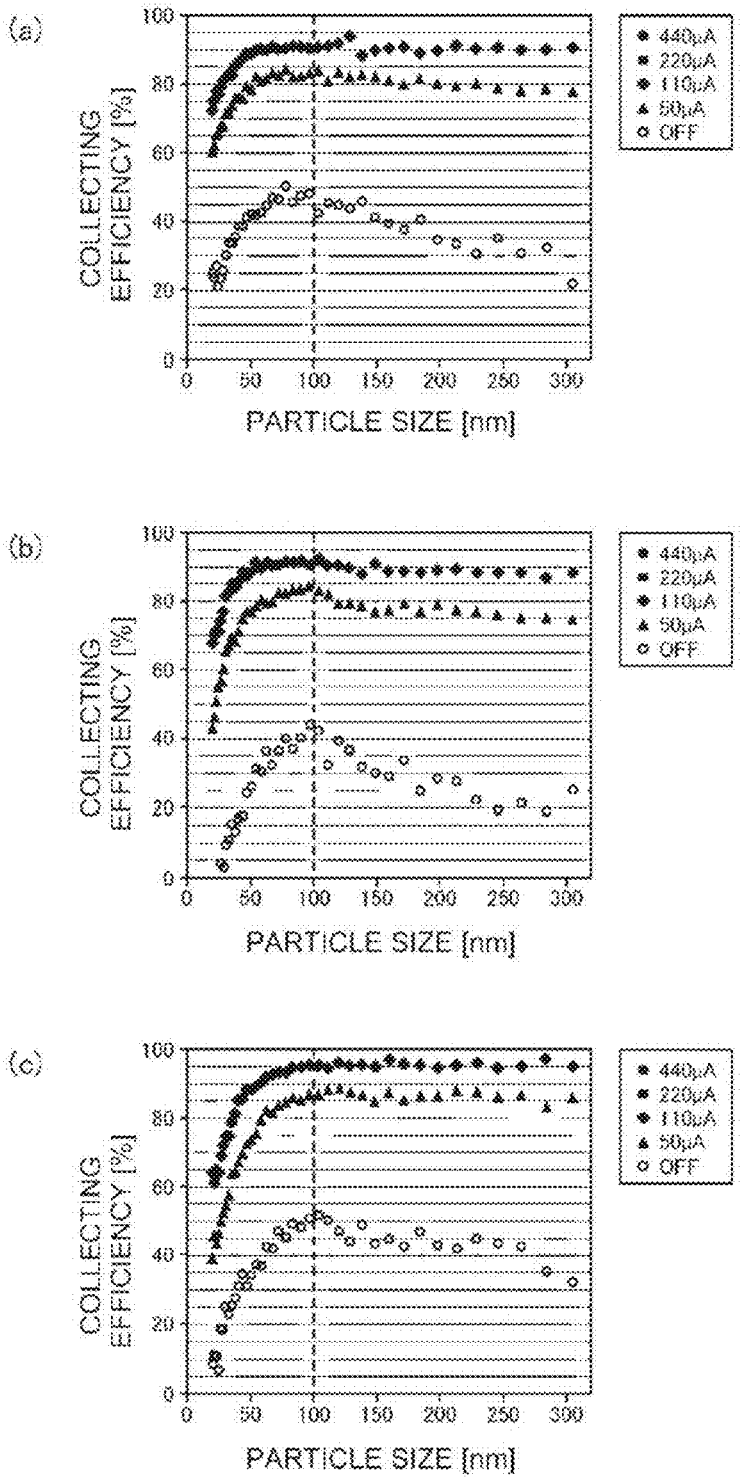

[Figure 6]
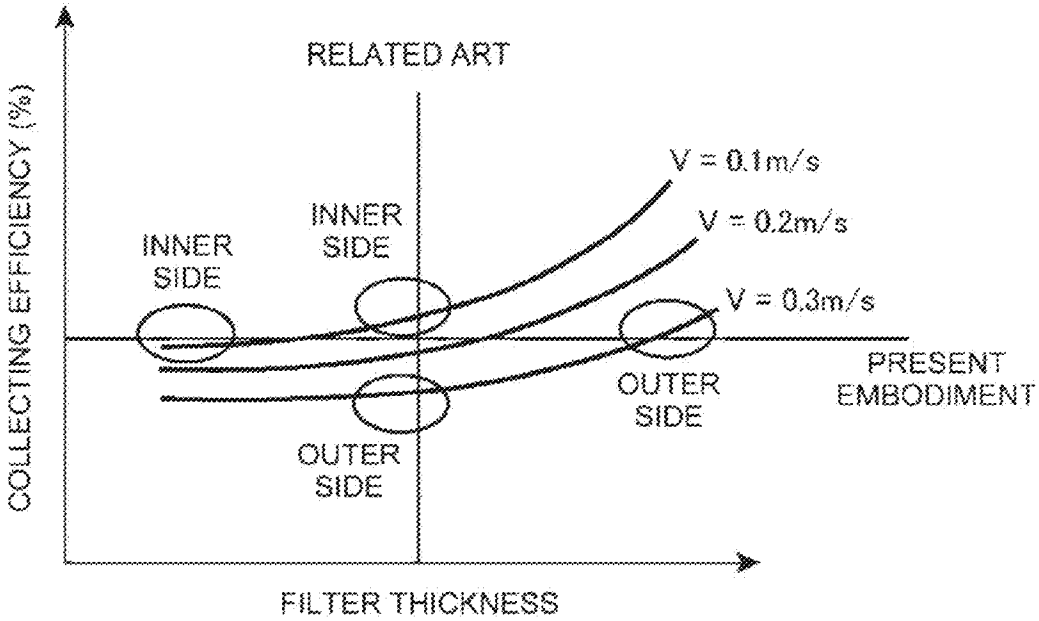

【Figure 7】
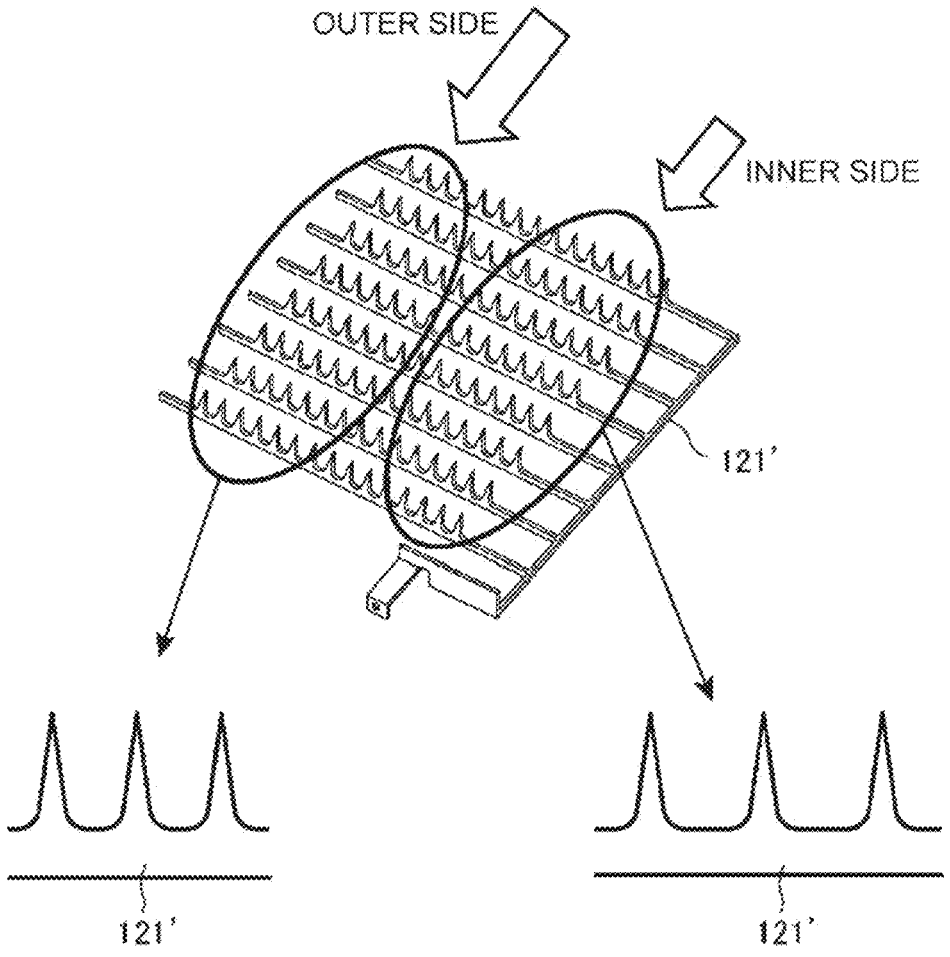

IMAGE FORMING APPARATUS WITH PARTICLE COLLECTOR

CROSS-REFERENCE TO RELATED APPLICATIONS

This is a US National Stage Application of International Application No. PCT/KR2018/011917, filed Oct. 11, 2018, which claims priority to Japanese Application No. 2018-001771, filed Jan. 10, 2018, the disclosures of which are incorporated herein in their entireties by reference.

BACKGROUND

In various electric apparatus, electronic apparatus, and the like, heat generating members exist in the apparatuses. In a case where a large amount of heat is generated, the heat needs to be positively released to the outside of the apparatus from the viewpoint of stable operation of the apparatus and the like. Such heat releasing is generally performed through air exhaustion by a fan. At this time, in some cases, a dust collecting device may be used so that dust and particles in the apparatus will not be exhausted to the outside of the apparatus together with the air exhaustion. For example, in an image forming apparatus such as a laser printer, a toner including fine particles is used in the apparatus, and a dust collecting device is provided in order to prevent the toner and ultra-fine particles or the like based on the toner components from being exhausted to the outside of the apparatus.

BRIEF DESCRIPTION OF THE DRAWINGS

FIG. 1 is a diagram illustrating an example particle (e.g., dust) collecting device provided in an image forming apparatus.

FIG. 2 is a partially cutaway perspective diagram illustrating the example particle collecting device.

FIG. 3 is a diagram illustrating an example particle collecting device and a charging unit provided in a flow passage.

FIGS. 4(*a*) to 4(*c*) are diagrams illustrating an example charging unit, FIG. 5(*a*) to FIG. 5(*c*) are graphs showing an example relationship between a particle size and collecting efficiency.

FIG. 6 is a diagram illustrating an example relationship between collecting efficiency and filter thickness.

FIG. 7 is a diagram illustrating another example charging unit.

DETAILED DESCRIPTION

In the following description, with reference to the drawings, the same reference numbers are assigned to the same components or to similar components having the same function, and overlapping description is omitted.

It is to be understood that not all aspects, advantages and features described herein may necessarily be achieved by, or included in, any one particular example. Indeed, having described and illustrated various examples herein, it should be apparent that other examples may be modified in arrangement and detail.

Miniaturization or reduced size is designed into many industrial products, including image forming apparatus, which can impact the layout of parts in the apparatus. Additionally, miniaturization can affect the flow passage where the particle (e.g., dust) collecting device is provided in the air exhaustion. In some examples, the flow passage may be curved or bent in order to effectively utilize the space.

If the flow passage is curved or bent, the speed of the fluid passing through the flow passage is different between the inside and the outer side of the curving or bending of the flow passage. When a filter (e.g., dust collecting device) is provided at in the curved or bent flow passage, the collected particles may not be uniformly introduced into the filter, which may impact the ability to maintain uniform collecting efficiency.

In addition, due to the centrifugal force, the particles having larger particle sizes are likely to be collected toward the outer side which may impact the ability to achieve uniform collecting efficiency in the direction perpendicular to the flow passage direction.

Disclosed herein is an example particle collecting device which is installed in a flow passage and which can obtain uniform collecting efficiency even in a case where there is a bias in flow velocity or in a case where there is a bias in particle size in a cross section of a flow passage due to the curving or bending of the flow passage.

The example particle collecting device may include a filter which collects particles in a fluid passing through the flow passage. In some examples, a distribution in particle collecting performance of the filter in a direction perpendicular to the flow passage direction corresponds to a distribution in flow velocity of the fluid flowing in the flow passage in the direction perpendicular to the flow passage direction or a distribution in average particle size of the particles flowing in the flow passage. The distribution in particle collecting performance of the filter may be generated due to curving or bending of the flow passage.

In some examples, the distribution in particle collecting performance of the filter in the direction perpendicular to the direction of the flow passage is formed by changing a thickness of the filter from an inner side to an outer side of the curving or bending.

Additionally, the distribution in particle collecting performance of the filter in the direction perpendicular to the flow passage direction may be formed by changing a pore size of the filter from an inner side to an outer side of the curving or bending.

Still further, the distribution in particle collecting performance of the filter in the direction perpendicular to the flow passage direction may be formed by changing a pore density of the filter from an inner side to an outer side of the curving or bending.

In some examples, a charging unit (i.e., charging device) which charges the particles in the fluid passing through the flow passage is provided on an upstream side of the filter in the flow passage. A distribution in chargeability of the charging unit in the direction perpendicular to the flow passage direction may correspond to the distribution in flow velocity of the fluid flowing in the flow passage in the direction perpendicular to the flow passage direction. In other examples, the distribution in chargeability of the charging unit may correspond to the distribution in average particle size of the particles flowing in the flow passage. The distribution in particle collecting performance of the filter may be generated due to the curving or bending of the flow passage.

The distribution in chargeability of the charging unit in the direction perpendicular to the flow passage direction may be configured to correspond to the distribution in flow velocity of the fluid flowing in the flow passage so that a charging amount is increased from an inner side to an outer side of the curving or bending. In other examples, the distribution in chargeability of the charging unit may be configured to correspond to the distribution in average particle size of the particles flowing in the flow passage so that the charging amount is decreased from the inner side to the outer side of the curving or bending.

The charging unit may include a high-voltage electrode having a plurality of needle-shaped protrusions which is supplied with a high voltage from a high-voltage generation circuit to generate electric field concentration. Additionally, the charging unit may include a counter electrode which is provided to face the high-voltage electrode to be supplied with a reference voltage from the high-voltage generation circuit. In some examples, the distribution in chargeability of the charging unit in the direction perpendicular to the flow passage direction may be formed by changing an inter-electrode gap between the high-voltage electrode and the counter electrode depending on a place. In other examples, the distribution in chargeability of the charging unit may be formed by changing an installation density of the needle-shaped protrusions depending on the place. In still other examples, the distribution in chargeability of the charging unit may be formed by changing a tip shape of the needle-shaped protrusions depending on the place. In yet further examples, the distribution in chargeability of the charging unit may be formed by changing a voltage applied to the needle-shaped protrusions depending on the place.

The example particle collecting device may include an electret-treated filter or a filter formed to have a honeycomb shape. In other examples, the filter may be formed to have a pleat shape or formed with a non-woven fabric having basis weight.

In some examples, an image forming apparatus may include an example particle collecting device as disclosed herein.

In some examples, the distribution in particle collecting performance of the filter in the direction perpendicular to the direction of the flow passage corresponds to the distribution in flow velocity of the fluid flowing in the flow passage in the direction perpendicular to the flow passage direction. In other examples, the distribution in particle collecting performance of the filter which is generated due to the curving or bending of the flow passage corresponds to the distribution in average particle size of the particles flowing in the flow passage. As a result, uniform collecting efficiency may be obtained in a cross section of the flow passage.

FIG. 1 is a diagram illustrating an example particle (e.g., dust) collecting device 11 provided in an image forming apparatus 1. In FIG. 1, the lower diagram is a simulation diagram illustrating a state of air exhaustion (heat release) from the vicinity of a fixing unit 14 and the upper diagram is a diagram illustrating the vicinity of the location where the dust collecting device 11 is provided. FIG. 2 is a perspective diagram corresponding to the upper diagram of FIG. 1.

The image forming apparatus 1 may comprise a laser printer including a dust collecting device 11, a charging unit 12, a fan 13, and the fixing unit 14. The fixing unit 14 (i.e., fixing device) may comprise a heat roll type apparatus provided with a heating roller to fuse a toner transferred to a paper.

The dust collecting device 11, the charging unit 12, and the fan 13 are configured to perform air exhaustion and dust collection in order to release heat generated in the fixing unit 14, and to exhaust water vapor generated from the paper in the fixing unit 14, Additionally, the dust collecting device 11, the charging unit 12, and the fan 13 may be configured to prevent the toner itself or ultra-fine particles (UFPs) based on the toner component from being exhausted to the outside of the image forming apparatus 1, and/or prevent particles such as a toner in the image forming apparatus 1 from floating and contaminating each component of the image forming apparatus 1.

The image forming apparatus 1 may comprise hardware configured to perform operations such as charging, exposure, development, transferring, fixing, cleaning, and the like, according to the particular application of the image forming apparatus 1.

As illustrated in FIG. 1, due to the exhaust from the fan 13, an air flow is generated in each component of the image forming apparatus 1, and these air flows are eventually collected to become a flow passage connected to the exhaust from the fan 13.

The dust collecting device 11 and the charging unit 12 are provided on the flow passage that collects air flows from these various components, and this flow passage is formed as a curved flow passage for the situation of arrangement of parts in the image forming apparatus 1. FIG. 3 is a diagram illustrating an example flow passage F.

The flow passage F may be formed with a member such as a duct for forming the flow passage F, or the flow passage may be configured with a gap between other members in the image forming apparatus 1.

The dust collecting device 11 is provided in the flow passage F and is configured with a filter. In the filter, a distribution in particle collecting performance in a direction perpendicular to the flow passage direction of the flow passage F corresponds to a distribution in flow velocity of the fluid flowing in the flow passage F in the direction perpendicular to the flow passage direction of the flow passage F, which is generated due to the curving of the flow passage F.

In some examples, with respect to the distribution in cross section of the flow passage F in flow velocity of the fluid, a distribution different from that of the ordinary straight flow passage is formed in the curved (or bent) flow passage F. The dust collecting device 11 may be provided with a filter having a distribution in collecting performance corresponding to the above-described distribution. For example, as illustrated in FIGS. 1 to 3, a filter may include a shape having a thickness which gradually increases from the inner side to the outer side of the curved flow passage F.

The particle collecting performance of the filter may be a function of one or more characteristics of the filter, such as a thickness, a pore size, and a pore density of the filter. By changing these characteristics, the collecting efficiency of the filter can be adjusted.

In some examples, a thicker filter, a smaller pore size, and/or a larger pore (mesh) density may be associated with an increased collecting performance and collecting efficiency.

The charging unit 12 is provided on the upstream side of the dust collecting device 11 in the flow passage F and charges the particles passing through the flow passage F in order to increase the dust collecting capability of the example electret-treated filter.

FIG. 4(*a*) is a schematic diagram illustrating the charging unit 12. The charging unit 12 is configured to include a high-voltage electrode 121 having a plurality of needle-shaped protrusions which is supplied with a high voltage from a high-voltage generation circuit (not specifically illustrated) to generate an electric field concentration. Additionally, the charging unit 12 includes a counter electrode 122 which is provided to face the high-voltage electrode 121 to be supplied with a reference voltage from the high-voltage generation circuit.

As illustrated in FIG. 4(*b*), the high-voltage electrode 121 is configured such that a plurality of comb-shaped electrodes having needle-shaped protrusions aligned in a row, are connected in parallel. The counter electrode 122 is a plate-shaped electrode arranged between a plurality of the comb-shaped electrodes aligned in parallel.

As illustrated in FIG. 4(*a*), a fluid (e.g., such as air) flowing in the flow passage F passes through the space where the high-voltage electrode 121 and the counter electrode 122 are arranged, so that particles contained in the fluid are charged, and the charged particles are collected by an electret-treated filter.

FIGS. 5(*a*) to 5(*c*) are graphs showing an example relationship between the particle size and the collecting efficiency. FIG. 5(*a*) shows a case where the thickness of the filter is 10 mm and the wind speed (flow velocity) in the flow passage is 035 m/s. FIG. 5(*b*) shows a case where the thickness of the filter is 10 mm and the wind speed in the flow passage is 0.50 m/s. FIG. 5(*c*) shows a case where the thickness of the filter is 20 mm and the wind speed in the flow passage is 0.50 m/s. In these example relationships, the filter has a uniform thickness and the flow passage is linear.

Each plot of FIGS. 5(*a*) to 5(*c*) corresponds to the current flowing in the charging unit, with the charging unit turned off and the current flows are 50 μA and 110 μA, respectively.

By comparing FIG. 5(*a*) with FIG. 5(*b*), it can be seen that the collecting efficiency in FIG. 5(*b*) is lower overall. In some examples, the collecting efficiency of the particles having a particle size of 100 nm in the case of turning off the charging unit (plot of open circles) is about 50% in FIG. 5(*a*) (the filter thickness is 10 mm, and the wind speed is 0.35 m/s) and drops to about 45% in FIG. 5(*b*) (the filter thickness is 10 mm, and the wind speed is 0.50 m/s). In a case where the thickness of the filter is the same, the collecting efficiency is decreased as the wind speed is increased.

When the distribution in flow velocity of the fluid flowing in the flow passage in the direction perpendicular to the flow passage direction is generated due to the curving of the flow passage, the collecting efficiency associated with a filter having a uniform thickness is decreased in the portion where the flow velocity is increased. Accordingly, in this configuration, the collecting efficiency may be non-uniform.

By comparing FIG. 5(*a*) with FIG. 5(*c*), it can be seen that the collecting efficiency is substantially equal. In some examples, the collecting efficiency of particles having a particle size of 100 nm in the case of turning off the charging unit is about 50% in FIG. 5(*a*) (the filter thickness is 10 mm, and the wind speed is 0.35 m/s) and is about 50% in FIG. 5(*c*) (the filter thickness is 20 mm, and the wind speed is 0.50 m/s). By increasing the thickness of the filter corresponding to an increase in wind speed, the collecting efficiency is maintained equal.

Accordingly, a uniform collecting efficiency may be obtained even when the distribution in flow velocity of the fluid flowing in the flow passage in the direction perpendicular to the flow passage direction is generated due to the curving of the flow passage, by using a filter having a thickness which varies correspondingly.

FIG. 6 is a diagram illustrating an example relationship between collecting efficiency and filter thickness. For filters having a uniform thickness, if there occurs a distribution in the flow velocity, the collecting efficiency becomes non-uniform according to the distribution.

On the other hand, a uniform collecting efficiency may be obtained for a dust collecting device 11 including a filter with varying thickness, since the distribution in particle collecting performance in the direction perpendicular to the flow passage direction of the flow passage F corresponds to the distribution in flow velocity of the fluid flowing in the flow passage F in the direction perpendicular to the flow passage direction of the flow passage F, which is generated due to the curving of the flow passage F.

In some examples, a uniform collecting efficiency can be obtained even when the distribution in flow velocity of the fluid flowing in the flow passage in the direction perpendicular to the flow passage direction is generated due to the curving of the flow passage. The uniform collecting efficiency can be obtained over the entire filter in order to improve the life cycle of the filter. Such a configuration may avoid the situation in which the load concentrates on the filter portion in the region with a high speed, which may in turn result in clogging and a decreased life cycle of the filter. On the other hand, if the entire surface of the filter is used with the same load, the life cycle of the filter may be lengthened.

In some examples, the "distribution in particle collecting performance of the filter in the direction perpendicular to the direction of the flow passage" is formed by changing the thickness of the filter.

For example, by changing the pore size of the filter or by changing the pore density of the filter, the "distribution in particle collecting performance of the filter in the direction perpendicular to the direction of the flow passage" may be formed. By allowing the pore size of the filter to be smaller from the inner side to the outer side of the curving (or bending) or by allowing the pore density of the filter to be larger from the inner side to the outer side of the curving (or bending), the "distribution in particle collecting performance of the filter in the direction perpendicular to the direction of the flow passage" may be formed.

On the other hand, as a result of a centrifugal force due to the curving (or bending) of the flow passage, the particles having a large particle size gather on the outside, and the particles having a small particle size gather on the inside (the average particle size on the outside becomes large, and the average particle size on the inside becomes small). Accordingly, the particles may be separated and collected by particle size. In such a case, at each position of the filter from the inner side to the outer side of the duct, the filter thickness (the smaller the average particle size, the larger the filter thickness), the pore size (the smaller the average particle size, the smaller the pore size), and the pore density (the smaller the average particle size, the higher the pore density) of the filter may be set according to the average particle size. As a result, a non-uniformity of pressure loss of the filter may be reduced in order to obtain uniform collecting efficiency and high collecting capability. For a filter having a distribution in collecting performance corresponding to the distribution in average particle size of the particles flowing in the flow passage, uniform collecting efficiency may be obtained even when a distribution in particle size of the particles flowing in the flow passage is generated.

The "distribution in particle collecting performance of the filter in the direction perpendicular to the direction of the flow passage" may be formed by adjusting any one or more of the filter thickness, the pore size, and the pore density, or any combination thereof.

In some examples, the filter may not be subjected to the electret treatment, Instead, the charged particles may be collected by applying a voltage to the filter. In addition, various types of filters such as a filter formed to have a honeycomb shape or a pleat shape or formed with a non-woven fabric having basis weight can be used.

Other types of charging units may also be used which include a distribution in chargeability.

For example, the distribution in chargeability of the charging unit in the direction perpendicular to the flow passage direction may correspond to the distribution in flow velocity of the fluid flowing in the flow passage in the direction perpendicular to the flow passage direction or the distribution in average particle size of the particles flowing in the flow passage, which is generated due to the curving or bending of the flow passage. In some examples, the distribution in chargeability of the charging unit in the direction perpendicular to the flow passage direction may be configured so that the charging amount is increased from the inner side to the outer side of the curving or bending.

As a result, the particles may be charged with a larger charging amount in the location where the flow velocity is fast in order to efficiently collect the particles entering the dust collecting device at a high speed.

The "distribution in chargeability of the charging unit in the direction perpendicular to the flow passage direction" can be formed by changing the inter-electrode gap between the high-voltage electrode and the counter electrode depending on the place, and/or by changing the installation density of the needle-shaped protrusions of the high-voltage electrode depending on the place. Additionally, the distribution in chargeability of the charging unit in the direction perpendicular to the flow passage direction" can be formed by changing the tip shape of the needle-shaped protrusions of the high-voltage electrode depending on the place, and/or changing the voltage applied to the needle-shaped protrusions of the high-voltage electrode depending on the place.

In some examples, by changing an inter-electrode gap between the high-voltage electrode 121 and the counter electrode 122 illustrated in FIG. 4(*a*) depending on the place (for example, by reducing the inter-electrode gap from the inner side to the outer side of the curving or bending), the "distribution in chargeability of the charging unit in the direction perpendicular to the flow passage direction" can be formed.

In addition, by changing the pitch of the needle-shaped protrusions of the high-voltage electrode 121 illustrated in FIG. 4(*c*) depending on the place (for example, by reducing the pitch of the needles from the inner side to the outer side of the curving or bending), the "distribution in chargeability of the charging unit in the direction perpendicular to the flow passage direction" can be formed. An example of such a structure is illustrated in FIG. 7. As illustrated in FIG. 7, by providing the high-voltage electrode 121' in which the pitch of the needles is larger on the side which is the inner side of the curving of the flow passage and the pitch is smaller toward the outer side, the "distribution in chargeability of the charging unit in the direction perpendicular to the flow passage direction" can be formed. In some examples, when a leakage current is generated by decreasing the pitch of the needle-shaped protrusions, the height of the needle-shaped protrusion is appropriately decreased so that such a leakage current is not generated.

As illustrated in FIG. 4(*b*), instead of electrically connecting in parallel comb-shaped electrodes where needle-shaped protrusions are aligned in a row, different voltages may be individually applied (for example, by applying a higher voltage from the inner side to the outer side of the curving or bending) in order to form the "distribution in chargeability of the charging unit in the direction perpendicular to the flow passage direction".

In addition, the shape of the tip of the needle-shaped protrusion of the high-voltage electrode may be changed in order to form the "distribution in chargeability of the charging unit in the direction perpendicular to the flow passage direction". As the shape of the tip of the electrode is sharpened, the chargeability becomes higher (however, the electrode is easily deteriorated), so that the distribution in chargeability is formed by using such an electrode.

In some examples, the "distribution in chargeability of the charging unit in the direction perpendicular to the flow passage direction" is formed so as to correspond to the distribution in flow velocity of the fluid flowing in the flow passage in the direction perpendicular to the flow passage direction, which is generated due to the curving or bending of the flow passage. Accordingly, a uniform collecting efficiency in the cross section of the flow passage may be obtained even when the distribution in flow velocity of the fluid flowing in the flow passage in the direction perpendicular to the flow passage direction is generated due to the curving of the flow passage.

As a result of a centrifugal force due to the curving (or bending) of the flow passage, the particles having a large particle size gather on the outside, and the particles having a small particle size gather on the inside (the average particle size on the outside becomes large, and the average particle size on the inside becomes small) in order to separate the particles by particle size. In such a case, the "distribution in chargeability of the charging unit in the direction perpendicular to the flow passage direction" may be formed so as to correspond to the distribution in average particle size of the particles flowing in the flow passage. A larger average particle size of the particles facilitates collection of the particles by the filter at a smaller charging amount.

Therefore, a distribution in chargeability may be formed so that the charging amount is large in the location where the average particle size of the particles becomes small and the charging amount is small in the location where the average particle size of the particles becomes large (the method of forming the "distribution in chargeability"), Accordingly, a uniform collecting efficiency in the cross section of the flow passage may be obtained even when a distribution in average particle size of the particles flowing in the flow passage occurs due to the curving of the flow passage.

LIST OF REFERENCE NUMBERS

1: image forming apparatus, 11: particle collecting device, 12: charging device (charging device), 121: high-voltage electrode, 122: counter electrode, 13: fan, 14: fixing unit (fixing device).

The invention claimed is:

1. An image forming apparatus comprising:

a flow passage to define a direction of flow of a fluid passing through the flow passage, wherein the flow passage includes a curved portion; and a particle collecting device installed in the flow passage, the particle collecting device comprising a filter to collect particles contained in the fluid, wherein a distribution in particle collecting performance of the filter in a direction perpendicular to the direction of flow corresponds to:

a distribution in flow velocity of the fluid in the direction perpendicular to the direction of flow; or a distribution in average particle size of the particles contained in the fluid passing through the flow passage, and wherein the distribution in particle collecting performance is generated due to the curved portion of the flow passage.

2. The image forming apparatus according to claim 1, wherein the filter includes a varying thicknesses from an inner side of the curved portion to an outer side of the curved portion of the flow passage, and wherein the distribution in particle collecting performance of the filter in the direction perpendicular to the direction of flow results from the varying thicknesses of the filter.

3. The image forming apparatus according to claim 1, wherein the filter includes varying pore sizes from an inner side of the curved portion to an outer side of the curved portion of the flow passage, and wherein the distribution in particle collecting performance of the filter in the direction perpendicular to the direction of flow results from the varying pore sizes of the filter.

4. The image forming apparatus according to claim 1, wherein the filter includes varying pore densities from an inner side of the curved portion to an outer side of the curved portion of the flow passage, and wherein the distribution in particle collecting performance of the filter in the direction perpendicular to the direction of flow results from the varying pore densities of the filter.

5. The image forming apparatus according to claim 1, further comprising a charging device to charge the particles contained in the fluid, the charging device located upstream of the filter in the direction of flow of the fluid, wherein a distribution in chargeability of the charging device in the direction perpendicular to the direction of flow corresponds to:

the distribution in flow velocity of the fluid flowing in the flow passage in the direction perpendicular to the flow passage direction; or the distribution in average particle size of the particles in the fluid, and wherein the distribution in chargeability is generated due to the curved portion of the flow passage.

6. The image forming apparatus according to claim 5, wherein the distribution in chargeability of the charging device in the direction perpendicular to the direction of flow further corresponds to:

the distribution in flow velocity of the fluid in which a charging amount of the particles increases from an inner side of the curved portion to an outer side of the curved portion of the flow passage, or the distribution in average particle size of the particles contained in the fluid in which the charging amount of the particles decreases from the inner side of the curved portion to the outer side of the curved portion of the flow passage.

7. The image forming apparatus according to claim 5, wherein the charging device includes:

a high-voltage electrode having a plurality of needle-shaped protrusions to be supplied with a high voltage from a high-voltage generation circuit and to generate an electric field concentration; and a counter electrode which faces the high-voltage electrode and is to be supplied with a reference voltage from the high-voltage generation circuit, and wherein the distribution in chargeability of the charging device in the direction perpendicular to the direction of flow results from:

varying an inter-electrode gap between the high-voltage electrode and the counter electrode, varying an installation density of the needle-shaped protrusions, varying a tip shape of the needle-shaped protrusions, or varying a voltage applied to the needle-shaped protrusions.

8. The image forming apparatus according to claim 1, wherein the filter comprises:

an electret-treated filter;

a filter having a honeycomb shape;

a filter having a pleat shape; or a filter having a non-woven fabric having basis weight.

9. The image forming apparatus according to claim 1, wherein the flow passage is curved along an entire length of the flow passage.

10. An image forming apparatus, comprising:

a flow passage associated with a direction of flow, wherein the flow passage includes a curved portion; and a particle collecting device comprising a filter to collect particles contained in a fluid passing through the flow passage in the direction of flow, wherein a distribution in particle collecting performance of the filter in a direction perpendicular to the direction of flow results, at least in part, from the curved portion of the flow passage.

11. The image forming apparatus according to claim 10, wherein the distribution in particle collecting performance of the filter corresponds to a distribution in flow velocity of the fluid in the direction perpendicular to the direction of flow.

12. The image forming apparatus according to claim 10, wherein the distribution in particle collecting performance of the filter corresponds to a distribution in average particle size of the particles contained in the fluid passing through the flow passage.

13. The image forming apparatus according to claim 10, wherein the filter includes a varying thickness from an inner side of the curved portion to an outer side of the curved portion of the flow passage, and wherein the distribution in particle collecting performance of the filter results from the varying thickness of the filter.

14. The image forming apparatus according to claim 10, wherein the filter includes a varying pore size from an inner side of the curved portion to an outer side of the curved portion of the flow passage, and wherein the distribution in particle collecting performance of the filter results from the varying pore size of the filter.

15. The image forming apparatus according to claim 10, wherein the filter includes a varying pore density from an inner side of the curved portion to an outer side of the curved portion of the flow passage, and wherein the distribution in particle collecting performance of the filter results from the varying pore density of the filter.

* * * * *